US008833610B2

(12) United States Patent
Rothen

(10) Patent No.: US 8,833,610 B2
(45) Date of Patent: Sep. 16, 2014

(54) MELTING SYSTEM FOR BAGS

(75) Inventor: Michael Rothen, Langenfeld (DE)

(73) Assignee: Illinois Tool Works, Inc., Glenview, IL (US)

( * ) Notice: Subject to any disclaimer, the term of this patent is extended or adjusted under 35 U.S.C. 154(b) by 391 days.

(21) Appl. No.: 12/745,281

(22) PCT Filed: Nov. 28, 2008

(86) PCT No.: PCT/EP2008/010134

§ 371 (c)(1),
(2), (4) Date: May 28, 2010

(87) PCT Pub. No.: WO2009/068310

PCT Pub. Date: Jun. 4, 2009

(65) Prior Publication Data

US 2010/0308079 A1 Dec. 9, 2010

(30) Foreign Application Priority Data

Nov. 28, 2007 (DE) ..... 20 2007 016 705 U

(51) Int. Cl.
*B65D 35/28* (2006.01)
*B05C 11/10* (2006.01)
*B05C 17/005* (2006.01)

(52) U.S. Cl.
CPC ..... *B05C 11/1042* (2013.01); *B05C 17/00576* (2013.01)
USPC ..... 222/95; 222/146.2; 222/342; 222/386

(58) Field of Classification Search
CPC ..... B05C 17/00576; B05C 11/1042; B67D 7/82; B67C 7/0255
USPC ..... 222/95, 146.2, 146.5, 342, 386; 92/200, 92/215; 277/471, 931, 932; 219/421
See application file for complete search history.

(56) References Cited

U.S. PATENT DOCUMENTS 2,518,748 A 8/1950 Breer
3,904,083 A * 9/1975 Little ..... 222/82

(Continued)

FOREIGN PATENT DOCUMENTS

DE 2232601 1/1974
DE 10020571 10/2001

(Continued)

*Primary Examiner* — Daniel R Shearer
(74) *Attorney, Agent, or Firm* — Rankin, Hill & Clark LLP

(57) ABSTRACT

A device is provided for successively melting a solid working material, such as a hot melt adhesive, packed in a packaging bag, and for pressing the molten working material out of the packaging bag. The device includes a cylindrical receiving chamber provided with at least one outlet opening at the end for receiving the packaging bag filled with the working material and having a front end and a back end. At least one heating element (30) is positioned in the region of the at least one outlet opening for melting the working material at the front-end of the packaging bag, which has a discharge opening for the molten working material. A pressing device with a pressing plunger can be displaced within the receiving chamber and acts on the back end of the packaging bag. The device is protected from contaminations by molten working material when used with undersized packaging bags that are extremely filled in that the receiving chamber at the outlet end thereof facing the at least one outlet opening includes a ring-like constriction with a peripherally sealing contact surface for the packaging bag at least at an edge zone thereof surrounding the discharge opening.

5 Claims, 3 Drawing Sheets

(56) References Cited

U.S. PATENT DOCUMENTS

| | | | | | |
|---|---|---|---|---|---|
| 4,231,492 | A | * | 11/1980 | Rios | 222/1 |
| 4,661,688 | A | * | 4/1987 | Gabryszewski | 219/421 |
| 4,693,398 | A | * | 9/1987 | Voss et al. | 222/327 |
| 4,898,302 | A | * | 2/1990 | Byerly et al. | 222/49 |
| 4,953,739 | A | * | 9/1990 | Wooge et al. | 222/326 |
| 4,974,752 | A | * | 12/1990 | Sirek | 222/146.5 |
| 5,449,096 | A | * | 9/1995 | Sedlmeier | 222/386 |
| 5,957,338 | A | * | 9/1999 | Lehmann | 222/184 |
| 6,206,248 | B1 | * | 3/2001 | Popp et al. | 222/389 |
| 6,916,025 | B2 | * | 7/2005 | Brisson | 277/637 |
| 2001/0025864 | A1 | | 10/2001 | Meyer | |

FOREIGN PATENT DOCUMENTS

| | | | |
|---|---|---|---|
| EP | 0309716 | | 4/1989 |
| EP | 1514611 | | 3/2005 |
| WO | 93/04951 | | 3/1993 |
| WO | WO 2005120720 | A1 * | 12/2005 |
| WO | 2007/118907 | | 10/2007 |

* cited by examiner 10
12C
12C'
12B
12A,
12E
20
24C
22
24
28
24B
24A
40
30
14
26
28
14A
12D
40A
14A 24C
22
28
24
20
12C
12C'
10
24B
24A
12
26
18A
26A
12A,
12E
16
12B
18
18D
30
40
16A
18C
12D
18B
14A
14
14A
40A

MELTING SYSTEM FOR BAGS

This application claims priority to and the benefit of the filing date of International Application No. PCT/EP2008/010134, filed 28 Nov. 2008, which application claims priority to and the benefit of the filing date of German Application No. 20 2007 016 705.9, filed 28 Nov. 2007, both of which are hereby incorporated by reference into the specification of this application.

FIELD OF THE INVENTION

The present invention relates to a device known as a bag melter for successively melting a solid working material, such as a hot melt adhesive, packed in a packaging bag, and for pressing the molten working material out of the packaging bag. The melting device comprises a cylindrical receiving chamber provided with at least one outlet opening at an end for receiving the packaging bag filled with the working material and having an inlet end opposite the at least one outlet opening which is used for appropriately inserting the packaging bag into the receiving chamber. At least one heating element is provided in the region of the at least one outlet opening of the receiving chamber for melting the working material at a front end of the packaging bag having a discharge opening for the molten working material, the packaging bag typically remaining closed on its back end. A pressing device with a pressing plunger that can be moved within the receiving chamber and acts on the back end of the packaging bag is used to press the molten working material out of the packaging bag and the receiving chamber of the melting device.

TECHNOLOGICAL BACKGROUND

Melting devices of the type mentioned above are successfully used in the market, particularly for the dosed discharge of hot melt adhesives. To insert the filled packaging bags with as little obstruction as possible into the receiving chamber of the melting device, it is important to prevent the inner cylinder wall of the receiving chamber, at least its heated sections, and the pressing plunger from coming into contact with the adhesive. Otherwise, major cleaning steps will be required before another packaging bag can be inserted into the melting device. It should therefore be prevented, in particular, that adhesive molten at the discharge opening of the packaging bag can get to the outside of the bag and thus onto the cylinder wall of the receiving chamber.

The required sealing between the edge zone surrounding the discharge opening of the packaging bag and the inner cylinder wall of the receiving chamber was achieved in the past by not filling the packaging bags to tautness with working materials. Instead, a certain oversize of the packaging bag was allowed that resulted in wrinkles forming on the packaging bag filled with solid working materials. The volume expansion of the working material that accompanies its heating in the melting process then resulted in full inflation of the packaging bag and its tight abutment with the inner cylinder wall of the receiving chamber of the melting device in the region of the heating zone. This was supported by the ejection pressure generated by the pressing device and applied to the molten hot melt adhesive.

The packaging bag could not be completely emptied at the end due to the wrinkling of the packaging bag mentioned above. Instead, a residual quantity of working material remained in the wrinkles of the packaging bag that had been compressed in axial direction by the pressing plunger. This entails not just a loss of hot melt adhesive but also an environmental problem because the pressed out packaging bags could no longer be recycled but had to be disposed of as hazardous waste, which was relatively expensive.

It is therefore desirable to switch to packaging bags that are somewhat undersized and filled to tautness with working material so that the wrinkling mentioned above will not occur. It is also required to produce the packaging bag tightly filled with solid working matter at a slightly smaller size than the cross section of the receiving chamber of the melting device so that it can be inserted into the receiving chamber with an adequate effort. It has been found that a tight filling of the packaging bag in conjunction with its required undersize relative to the receiving chamber can lead to the packaging bag no longer being pressed tightly against the cylinder wall of the receiving chamber in the heating zone.

SUMMARY OF THE INVENTION

It is thus the problem of the invention to protect bag melting devices from contamination with molten working material when using tightly filled packaging bags. This problem is solved by proposing an exemplary melting device (bag melter) that has at least the characteristics listed in claim 1. According to an exemplary embodiment of the present invention, the receiving chamber in melting devices of this type is provided, at least on the outlet end facing the outlet opening, with a ring-like constriction having a peripherally sealing contact surface for the packaging bag at least at the edge zone surrounding the discharge opening of the packaging bag. Self-centering of the packaging bag in the area of the constriction is achieved if the constriction is tapering in the direction of the at least one outlet opening. The ring-like constriction may be designed as a detachable insert in, or add-on to, the outlet end of the receiving chamber for easier adjustment to differing specifications of the packaging bags and the working material and for easier cleaning.

According to one aspect, a pressing plunger for the exemplary device may be equipped with an extendable head plate the cross section of which is smaller than the cross section of the pressing plunger to empty the packaging bags as completely as possible even in the area of the constriction at the end of the emptying process. This solution is an inventive step in its own right; the desired sharpness of the leading peripheral edge of the pressing plunger can be retained. This is desirable for scraping and cleaning sliding along the cylinder wall of the receiving chamber.

The present invention ensures, inter alia, that the packaging bags are emptied relatively thoroughly of the molten working material without requiring too frequent cleaning of the receiving chamber and/or the pressing cylinder.

According to another aspect, if a compression spring is provided between the pressing plunger and a scraping or stripper plate, the scraping or stripper plate is extended in the pressureless idling state to avoid injuries when inserting the plunger into the cylinder. The compression springs is compressed in the pressing stage. This solution, too, is an inventive step in its own right.

The components to be used according to the invention as mentioned above and as claimed and described in the embodiments are not subject to special selection constraints regarding their size, shape, material, and engineering design so that the selection criteria known in the field of application can be applied without limitation.

Further details, characteristics, and advantages of the subject matter of the invention result from the subordinate claims as well as from the description of the associated figure and table showing an embodiment of a bag melter as an example.

DETAILED DESCRIPTION OF AN EMBODIMENT

Figure 2:
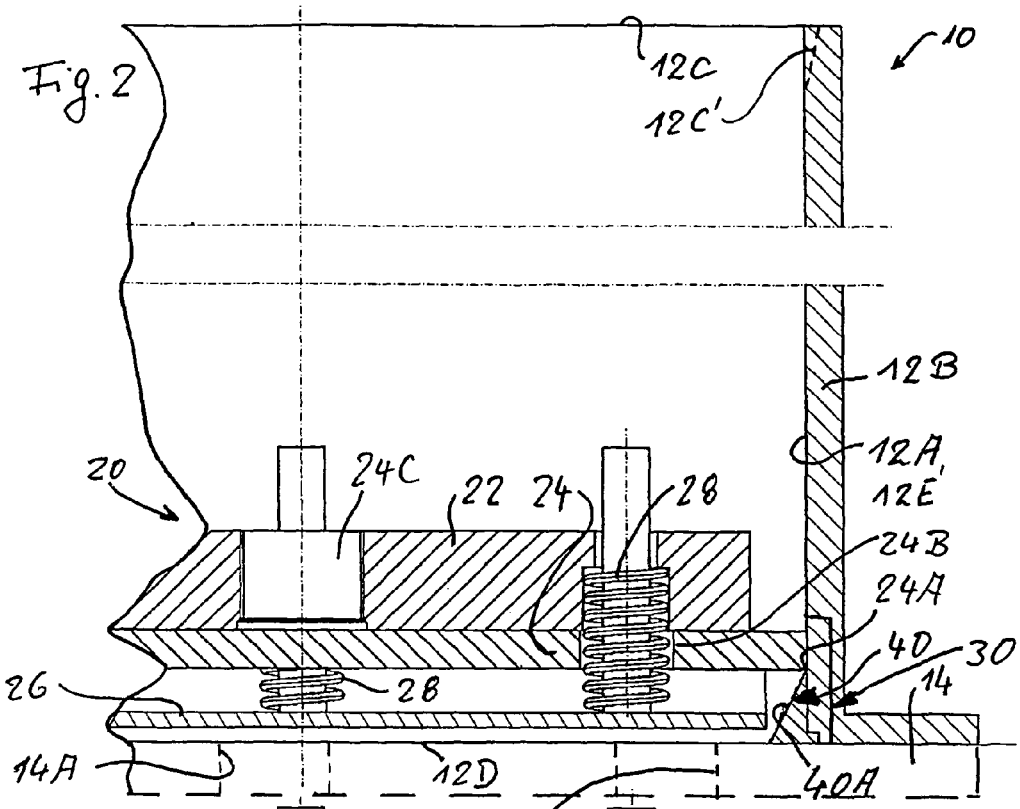
FIG. 2 shows the same device after pressing the molten working material out of the packaging bag; as well as FIG. 3A/B shows a top view of an exemplary stripper plate of the bag melter according to FIGS. 1 and 2.
Figure 1:
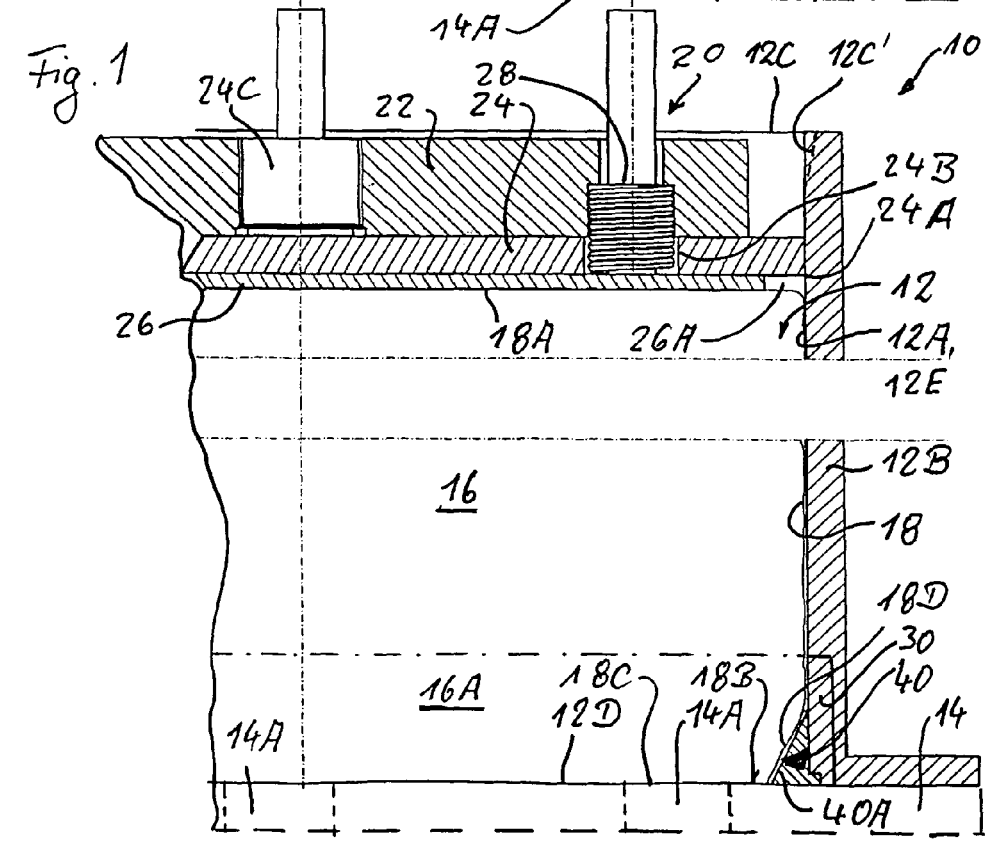
FIG. 1 shows a semilateral axial view of an exemplary bag melter with a freshly inserted and filled packaging bag.

Referring now to the drawings wherein the showings are for the purpose of illustrating preferred and alternative embodiments of the present invention only and not for the purpose of limiting same, an exemplary device or bag melter 10 is shown in two operating positions in FIGS. 1 and 2. The bag melter 10 includes a receiving chamber 12 surrounded by a cylindrical inner wall 12A. The wall 12B that encloses the receiving chamber 12 forms opposite outlet ends 12C and 12D at its upper and lower ends in operating position. The lower outlet end 12D is closed with an end plate 14 that comprises multiple discharge openings 14A. A packaging bag 18 tautly filled with a hot melt adhesive 16 is located inside the receiving chamber 12 (FIG. 1). The packaging bag is tightly sealed on its back end 18A that is shown in top position in the figure, and completely open on its bottom front end 18B, forming the discharge opening 18C. The packaging bag 18 tautly filled with solid working material is typically opened directly before it is inserted from top to bottom, i.e. from the upper outlet end 12C, into the receiving chamber 12. The pressing device 20 for the packaging bag 18 can be adequately removed for this purpose.

The pressing device 20 includes a pressing plunger 22 that can be moved in an axial direction within the receiving chamber 12. The pressing plunger 22 comprises a scraper or stripper plate 24 (e.g. made of PTFE, e.g. Teflon®) and has a sharp-edged circumferential scraping edge 24A. Low-loss sliding of the pressing plunger 22 along the cylinder wall and thus a fairly accurately defined pressure onto the molten working material 16A can be realized in the region of the lower heating zone in combination with an interior coating 12E of the wall 12B of the receiving chamber 12. The interior coating of the wall can be a PTFE coating.

The receiving chamber 12 comprises a ring-like constriction 40 in the region of its lower outlet end 12D. In the exemplary embodiment shown here, it has the shape of a ring that can be detachably inserted into the lower outlet end of the wall 12B of the receiving chamber 12. It has a gradually tapered wall, such as a conical wall, on the side facing the receiving chamber 12 that serves as sealing contact surface 40A. It has a self-centering effect on the packaging bag 18 when the bag is inserted into the receiving chamber 12. As soon as the heating element 30 causes melting in the region 16A of the working material 16, the edge zone 18D of the packaging bag 18 automatically comes to rest against the tapered sealing contact surface 40A. The lateral pressure exerted by the working material expanding under the pressure onto the edge zone 18D is typically sufficient to achieve this.

The pressing plunger 22 is further equipped with a head plate 26 that is connected to the pressing plunger 22 via a spring arrangement, such as pressure or compression springs 28 that are conducted through the scraping plate 24. The cross sectional surface of the head plate is smaller than the one of the scraping plate 24 in such a way that there remains a gap 26A between the outer rim of the head plate and the cylinder wall 12A of the receiving chamber 12. This gap 26A is dimensioned to allow penetration of the head plate 26 into the zone with a constricted cross section on the lower outlet end of the receiving chamber 12 by a definable length. The compression springs 24 are compressed by the pressure of the pressing plunger in the working position shown in FIG. 1. If however the packaging bag 18 is almost empty and the remaining working material in it has been liquefied, the pressure of the compression springs 28 is sufficient to move the head plate into the constriction area and press the last remnants of working material out of the packaging bag although the scraping plate 24 does not come down any further but stops in front of the constriction 40.

Figure 3A:
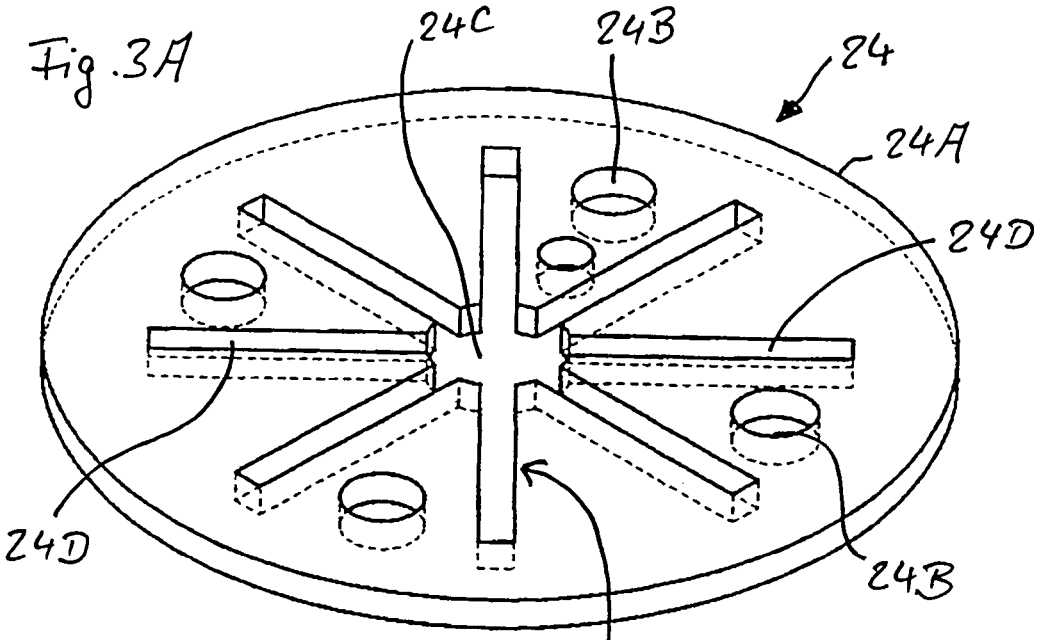

FIG. 3A shows a top view of the exemplary scraping or stripper plate 24 on which four openings 24B are visible around its perimeter for the compression springs 28. In addition, there is a central opening 24C from which eight recesses 24D extend in radial direction. This makes the scraping or stripper plate 24 somewhat deformable, e.g. it can be compressed by radial pressure towards the center and/or expanded radially outwards. If a scraping or stripper plate designed in this way is pressed into the receiving chamber 12 using an insertion cone 12C' at the upper outlet end 12C, the scraping edge 24A sits tightly against the cylindrical inner wall 12A of the receiving chamber 12. If the cross section of the receiving chamber 12 expands by heating in the region of the heating component 30, the cross section of the scraping or stripper plate 24 can follow suit with this expansion.

Figure 3B:
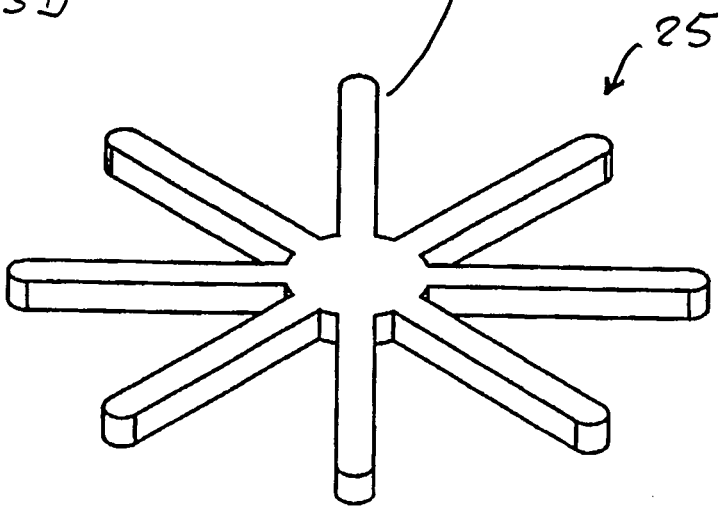

Due to the potentially large coefficient of thermal expansion of the scraping or stripper plate 24 as compared to the coefficient of thermal expansion of the wall 12B of the receiving chamber 12, it can be advantageous to design the scraping or stripper plate 24 with a nominal diameter that matches the nominal diameter of the cylindrical inner wall 12A of the receiving chamber 12 fairly exactly. To obtain good stripping results if the scraping or stripper plate 24 is increasingly heated up by the heating element 30, it can be advantageous that an expandable return element is inserted into the recess 24C, 24D. Such an element is shown in FIG. 3B and may, for example, be made of a rubber-elastic material. The outcome is that the scraping or stripper plate 24 can more easily expand again after initial radial compression when the inward radial forces decrease and/or that the scraping or stripper plate 24 can be returned to its original cross section after initial radial expansion due to the inserted return element 25 because of radial compression forces applied from outside. In general, a scraping or stripper plate 24 designed in that way and representing an inventive step in its own right helps keep the inner cylindrical wall 12A of the receiving chamber 12 clean and produces a particularly good sealing effect without damaging the antifriction coating 12E of the receiving chamber 12.

Figure 4B:
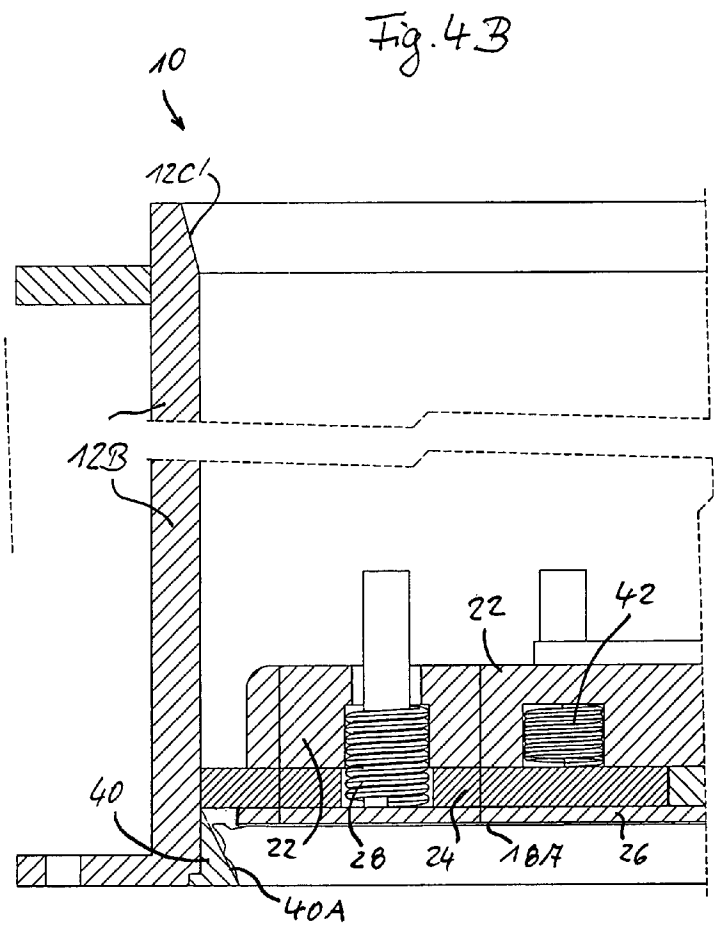
FIG. 4A/B shows an alternative exemplary embodiment with spring-supported scraping or stripper plate in pressureless or compressed state, respectively.
Figure 4A:
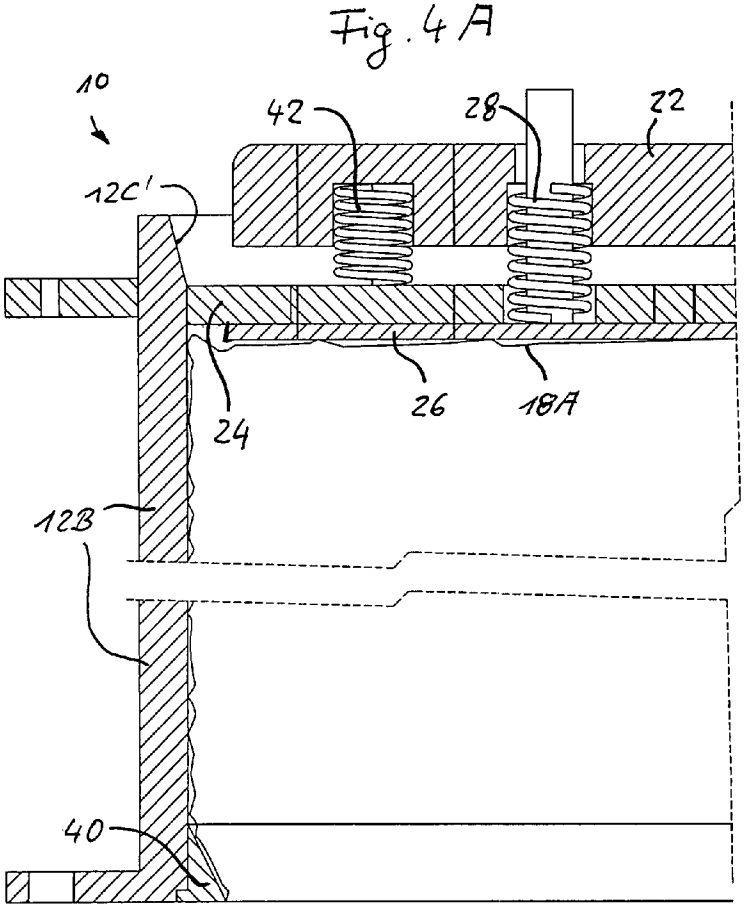

In the alternative exemplary embodiment according to FIG. 4 A/B, compression springs 42 are provided between the pressing plunger 22 and the scraping or stripper plate 24 so that they hold the scraping or stripper plate 24 at an axial spacing from the pressing plunger when expanded in the pressureless state (FIG. 4A). In the compressed state shown in FIG. 4B, the plunger pressure of the pressing plunger 22 is transferred to the scraping or stripper plate 24 in that it rests against it.

As is evident from the foregoing, the device 10 is adapted to successively melt a solid working material, such as the hot melt adhesive 16, packed in the packaging bag 18, and press the molten working material out of the packaging bag. The device 10 includes the cylindrical receiving chamber 12 provided with at least one outlet opening 14A at the end for receiving the packaging bag 18 filled with the working material. The packaging bag 18 has the back end 18A and the front end 18B having the discharge opening 18C for the molten working material. At one heating element 30 in the region of the at least one outlet opening 14A is provided for melting the working material at the front end 18A of the packaging bag 18. The pressing device 20 with a pressing plunger 22 can be moved within the receiving chamber 12 and acts on the back end 18A of the packaging bag.

The pressing plunger 22 is equipped with the scraping or stripper plate 24 that is in contact with the cylindrical inner wall 12A of the receiving chamber 12. The scraping or stripper plate 24 is provided with at least one recess 24C, 24D inserted into its axial upper side and/or its axial bottom side and/or between its axial upper and bottom sides and facilitating compression at least in radial direction of the scraping or stripper plate 24. The recess 24C, 24D have a radial design with radially extending strips. The at least one expandable return element 25 is inserted into the recess 24C, 24D of the scraping or stripper plate 24. The expandable return element 25 is rubber-elastic and can be deformed more easily than the scraping or stripper plate 24.

The pressing plunger 22 is also equipped with the head plate 26 having a reduced cross section compared to the cross section of the receiving chamber 12 that can be moved in axial direction relative to the pressing plunger. A spring arrangement such as the compression springs 28 advances the head plate 26 in axial direction when the head plate approaches or reaches the molten zone 16A of the meltable working material.

The receiving chamber is provided, at least on the outlet end 12D facing the outlet opening 14A, with the ring-like constriction 40 having the peripherally sealing contact surface 40A for the packaging bag at least at the edge zone 18D surrounding the discharge opening of the packaging bag. The sealing contact surface 40A of the constriction 40 is gradually, especially conically, tapered towards the lower outlet end 12D of the receiving chamber 12. The ring-like constriction 40 is an integral part of a ring element inserted in a fixed or detachable manner into the lower end region of the receiving chamber 12.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

LIST OF REFERENCE SYMBOLS

10 Bag melter
12 Receiving chamber
12A Cylindrical inner wall
12B Wall
12C Upper outlet end
12C' Insertion cone
12D Lower outlet end
12E Interior coating
14 End plate
14A Outlet openings
16 Hot-melt adhesive
16A Molten hot melt adhesive
18 Packaging bag
18A Back end
18B Front end
18C Discharge opening
18D Edgezone
20 Pressing device
22 Pressing plunger
24 Scraping or stripper plate
24A Scraping edge
24B Openings
24C Central openings
24D Radial recesses
25 Expandable return element
26 Head plate
26A Gap
28 Pressure spring
30 Heating element
40 Constriction
40A Tapered sealing contact surface
42 Compression springs

The invention claimed is

1. A device for successively melting a solid working material, and for pressing the molten working material out of a packaging bag, comprising a cylindrical receiving chamber provided with at least one outlet opening at the end for receiving an associated packaging bag filled with an associated working material, and the associated packaging bag having an associated front end and an associated back end, at least one heating element in the region of the at least one outlet opening for melting the associated working material at the associated front end of the associated packaging bag having an associated discharge opening for the associated molten working material, and a pressing device with an ejection piston that can be moved within the receiving chamber and acts on the associated back end of the associated packaging bag, wherein the ejection piston is provided with a head plate that has a cross-sectional configuration that is smaller than a cross-sectional configuration of the cylindrical receiving space and smaller than a cross-sectional configuration of a stripper plate of the ejection piston, and moves axially relative to the ejection piston and its stripper plate toward the at least one outlet opening wherein a spring arrangement biases the head plate toward the at least one outlet opening.

2. The device according to claim 1, wherein the spring arrangement biases the head plate toward the at least one outlet opening when the head plate nears or reaches the region of the at least one outlet opening of the associated meltable working material.

3. The device according to claim 1, further including an annular contraction with a continuously sealing support surface for the associated packaging bag, at least at an edge zone enveloping the associated discharge opening.

4. A bag melting device for successively melting a solid working material packaged in a packaging bag, namely hot-melt adhesive, and for pressing the melted working material out of the packaging bag, the device comprising:

a cylindrical receiving space provided with at least one end-side outlet opening for accommodating an associated packaging bag filled with an associated hot-melt adhesive and the associated packaging bag having an associated front end and an associated rear end, at least one heating element in the area of the at least one outlet opening for melting the associated hot-melt adhesive at the associated front end of the associated packaging bag having a delivery end for the associated melted working material, and an ejection device with an ejection piston that can traverse the interior of the receiving space and acts on the associated rear end of the associated packaging bag, and with the associated packaging bag accommodated in the bag melting device and accommodating the associated solid working material, wherein a mouth end of the receiving space facing the at least one outlet opening includes an annular contraction with a continuously sealing support surface for the associated packaging bag, at least at an edge zone enveloping an associated discharge opening of the associated packaging bag, and a head plate that penetrates into the zone with a constricted cross-section on the lower outlet end of the receiving space by a definable length, the head plate being biased toward the at least one outlet opening;

the ejection piston is provided with a scraping or stripping plate that contacts a cylindrical inner wall of the receiving space, the scraping or stripping plate is provided with at least one recess that is inserted in at least one of its axial upper side and axial lower side and between its axial upper and lower side, and enables at least a radial compression of the scraping or stripping plate during operation of the device as the associated melted working material is pressed out of the device, where the at least one recess is star-shaped, with radially extending strips.

5. A bag melting device for successively melting a solid working material packaged in a packaging bag, namely hot-melt adhesive, and for pressing the melted working material out of the packaging bag, the device comprising:

a cylindrical receiving space provided with at least one end-side outlet opening for accommodating an associated packaging bag filled with an associated hot-melt adhesive and the associated packaging bag having an associated front end and an associated rear end, at least one heating element in the area of the at least one outlet opening for melting the associated hot-melt adhesive at the associated front end of the associated packaging bag having a delivery end for the associated melted working material, and an ejection device with an ejection piston that can traverse the interior of the receiving space and acts on the associated rear end of the associated packaging bag, and with the associated packaging bag accommodated in the bag melting device and accommodating the associated solid working material, wherein a mouth end of the receiving space facing the at least one outlet opening includes an annular contraction with a continuously sealing support surface for the associated packaging bag, at least at an edge zone enveloping an associated discharge opening of the associated packaging bag, and a head plate that penetrates into the zone with a constricted cross-section on the lower outlet end of the receiving space by a definable length, the head plate being biased toward the at least one outlet opening;

wherein the ejection piston is provided with a scraping or stripping plate that contacts a cylindrical inner wall of the receiving space, the scraping or stripping plate is provided with at least one recess that is inserted in at least one of its axial upper side and axial lower side and between its axial upper and lower side, and enables at least a radial compression of the scraping or stripping plate during operation of the device as the associated melted working material is pressed out of the device; wherein at least one expandable restoring element is inserted in the at least one recess of the scraping or stripping plate; wherein the expandable restoring element is resilient, and configured to be more easily elastically deformed than the scraping or stripping plate.

* * * * *